US005193587A

United States Patent [19]

Miller, Jr.

[11] Patent Number: 5,193,587

[45] Date of Patent: Mar. 16, 1993

[54] PIPE THAWING APPARATUS

[76] Inventor: Floyd Miller, Jr., 9576 S. Harrodsburg Rd., Harrodsburg, Ind. 47434

[21] Appl. No.: 702,965

[22] Filed: May 20, 1991

[51] Int. Cl.[5] ..... E03B 7/14

[52] U.S. Cl. ..... 138/35; 138/32; 392/471

[58] Field of Search ..... 138/32, 35; 219/296, 219/310, 312

[56] References Cited

U.S. PATENT DOCUMENTS

| | | | |
|---|---|---|---|
| 735,449 | 8/1903 | Berger . | |
| 1,243,973 | 10/1917 | Philippon . | |
| 1,960,866 | 5/1934 | Chadwick . | |
| 2,062,246 | 11/1936 | Atkinson . | |
| 4,124,039 | 11/1978 | St. Laurent . | |
| 4,124,179 | 11/1978 | Powell et al. . | |
| 4,250,925 | 2/1981 | Mast . | |
| 4,438,757 | 3/1984 | Anderson . | |
| 4,449,553 | 5/1984 | Sullivan et al. | 138/35 |
| 4,986,311 | 1/1991 | Mikkelson | 138/35 |

*Primary Examiner*—James E. Bryant, III
*Attorney, Agent, or Firm*—Ice Miller Donadio & Ryan

[57] ABSTRACT

A pipe thawing apparatus has a heat exchanger for heating water. An electric water pump has an outlet coupled to an inlet of the heat exchanger. A flexible feed tube is coupled to an outlet of the heat exchanger. The electric water pump has an electric motor that is coupled to a source of electric power through a cyclical power interrupting device. The cyclical power interrupting device cyclically connects and disconnects the electric motor of the pump to the source of electric power cyclically turning the electric motor on and off. The water pump thus supplies a pulsating stream of water to the heat exchanger which in turn feeds a pulsating stream of heated water into the flexible feed tube. The flexible feed tube is advanced in the pipe to be thawed so that a pulsating stream of heated water is directed into the pipe, preferably against the ice to be melted. A return line is coupled between the pipe and an inlet of the water pump so that the water used by the apparatus is continuously recirculated.

The flexible feed tube has a tip having a spider extending radially therefrom to center the flexible feed tube in the pipe and to facilitate the advancing of the flexible feed tube through the pipe. The spider comprises a plurality of resilient fingers, preferably four, which extend radially outwardly and backwardly from the tip.

13 Claims, 3 Drawing Sheets

PIPE THAWING APPARATUS

BACKGROUND OF THE INVENTION

This invention relates to pipe thawing apparatuses, and more particularly to a pipe thawing apparatus that thaws a pipe by directing a stream of hot water into the pipe against ice in the pipe to melt the ice.

Frozen pipes and how to thaw them are problems encountered every winter in areas where temperatures drop below freezing. Until relatively recently, pipes have been made of metal and could be thawed by passing an electric current through them or by heating the pipes with a torch. However, plastic pipes, which are being used with increasing frequency in recent years, cannot be thawed by using either technique.

Apparatuses and techniques have been developed for thawing frozen plastic pipes. One technique is to break open the pipe and direct a stream of heated water into the pipe, to thaw the ice. This is done by advancing a flexible tube through the pipe and directing a stream of heated water through the tube. By advancing the flexible tube through the pipe, the outlet of the flexible tube is placed in close proximity to the ice in the pipe so that the heated water exiting the tube is immediately directed against the ice. Apparatuses utilizing this technique are disclosed in U.S. Pat. No. 4,124,039 to St. Laurent for a pipe thawing machine and in U.S. Pat. No. 4,250,925 to Mast for a pipe unfreezer.

Both the Mast device and the St. Laurent device are closed systems. That is, a return line is coupled to the pipe to be thawed and the flexible tubing inserted into the pipe through the return line. Water is thus recirculated from a source of hot water in the devices, through the feed tube into the pipe, and then back through the return line into the devices to be reheated. Since the system is closed, this avoids introducing contaminants into the pipe which is desirable since in many cases the pipes to be unthawed carry drinking water.

A problem which devices of this type must overcome is that the path the flexible tubing must follow in the pipe can be tortuous. The pipe may bend at angles, which in many cases are ninety degree angles, and there may frequently be junctions where pipes branch off from each other. Consequently, the tip of the flexible tubing may be provided with some type of guiding apparatus to facilitate the feeding of the flexible tubing through the pipe. For example, the flexible tubing or feed tube 16 shown in Mast has a distal or probing end that has a tip provided with elongate side expanses 28*a*, 28*b*, 28*c*, that are formed by cutting the sides of the feed tube to remove material whereby tapered fingers are left which form the expanses. Since the fingers are tapered, and unjoined from each other, they have a greater degree of pliancy than the feed tube 16 proper. When such a tip is advanced through a pipe, the fingers yieldably guide the tip around corners and other obstructions.

Another problem encountered with such devices is that when heated water is supplied in a steady stream to the pipe, a pressure head builds up. This pressure head tends to force the flexible feed tube back out of the pipe. This makes it more difficult to feed the flexible feed tube through the pipe.

It is an object of this invention to provide an apparatus for thawing pipes by advancing a flexible feed tube through the pipe and directing a pulsating stream of heated water through the flexible feed tube into the pipe.

It is another object of this invention to provide an apparatus where the stream of heated water can be selectively supplied as a continuous stream or a pulsating stream.

It is another object of this invention to provide an improved tip for a flexible feed tube used with an apparatus for thawing pipe that directs water into the pipe through the flexible feed tube to facilitate the advancement of the flexible feed tube through the pipe.

SUMMARY OF THE INVENTION

A pipe thawing apparatus according to this invention has a heat exchanger for heating water. An electric water pump has an outlet coupled to an inlet of the heat exchanger. A flexible feed tube is coupled to an outlet of the heat exchanger. The electric water pump has an electric motor that is coupled to a source of electric power through a cyclical power interrupting device. The cyclical power interrupting device cyclically connects and disconnects the electric motor of the pump to the source of electric power cyclically turning the electric motor on and off. The water pump thus supplies a pulsating stream of water to the heat exchanger which in turn feeds a pulsating stream of heated water into the flexible feed tube. The flexible feed tube is advanced in the pipe to be thawed so that a pulsating stream of heated water is directed into the pipe, preferably against the ice to be melted. A return line is coupled between the pipe and an inlet of the water pump so that the water used by the apparatus is continuously recirculated.

The flexible feed tube has a tip having a spider extending radially therefrom to center the flexible feed tube in the pipe and to facilitate the advancing of the flexible feed tube through the pipe. The spider comprises a plurality of resilient fingers, preferably four, which extend radially outwardly and backwardly from the tip.

Other objects, advantages and novel features of the present invention will become apparent from the following detailed description of the invention when considered in conjunction with the accompanying drawings.

DETAILED DESCRIPTION OF THE DRAWINGS

Figure 1:
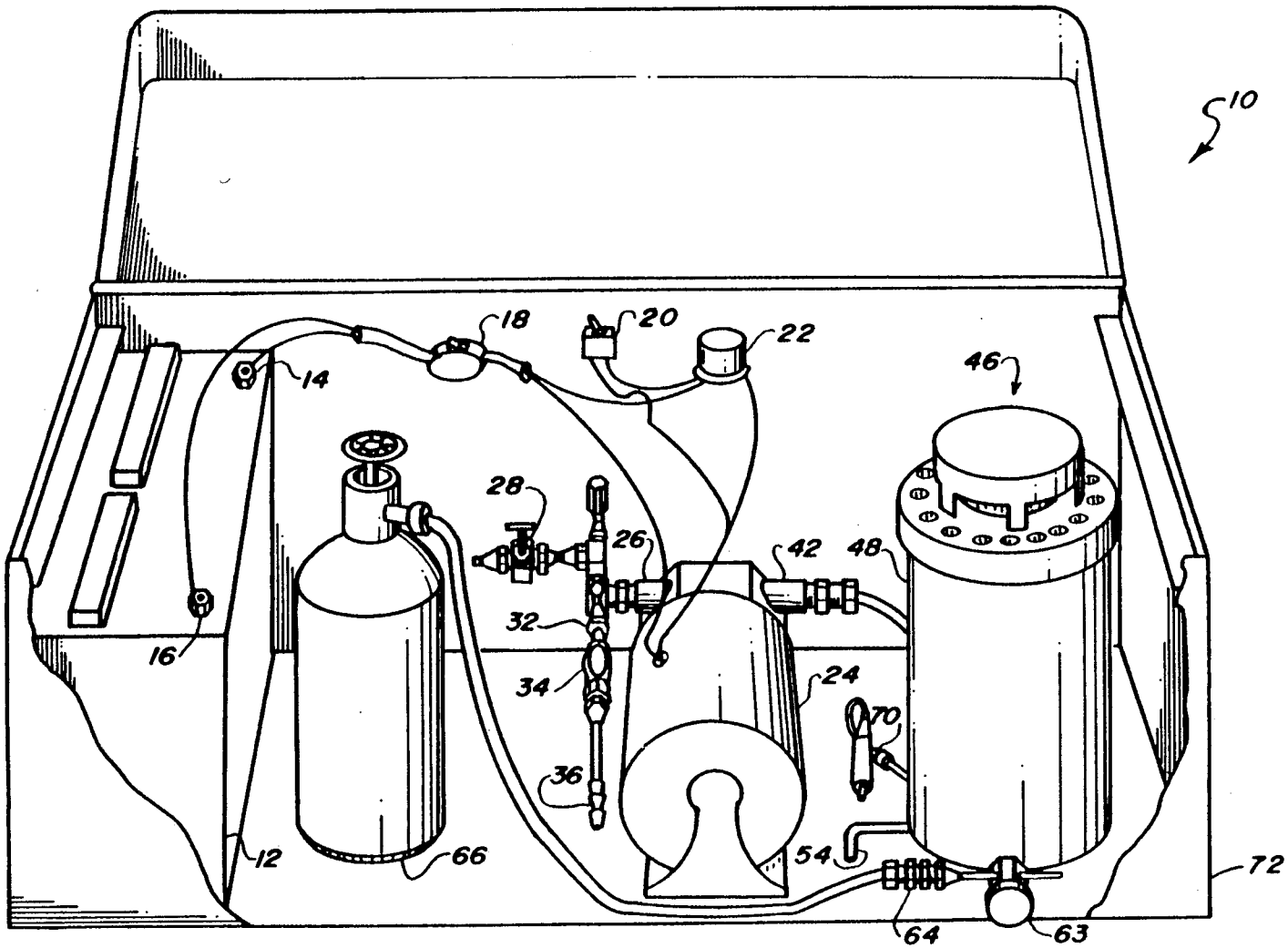
FIG. 1 is a perspective view of a pipe thawing apparatus made in accordance with the principles of this invention.
Figure 2:
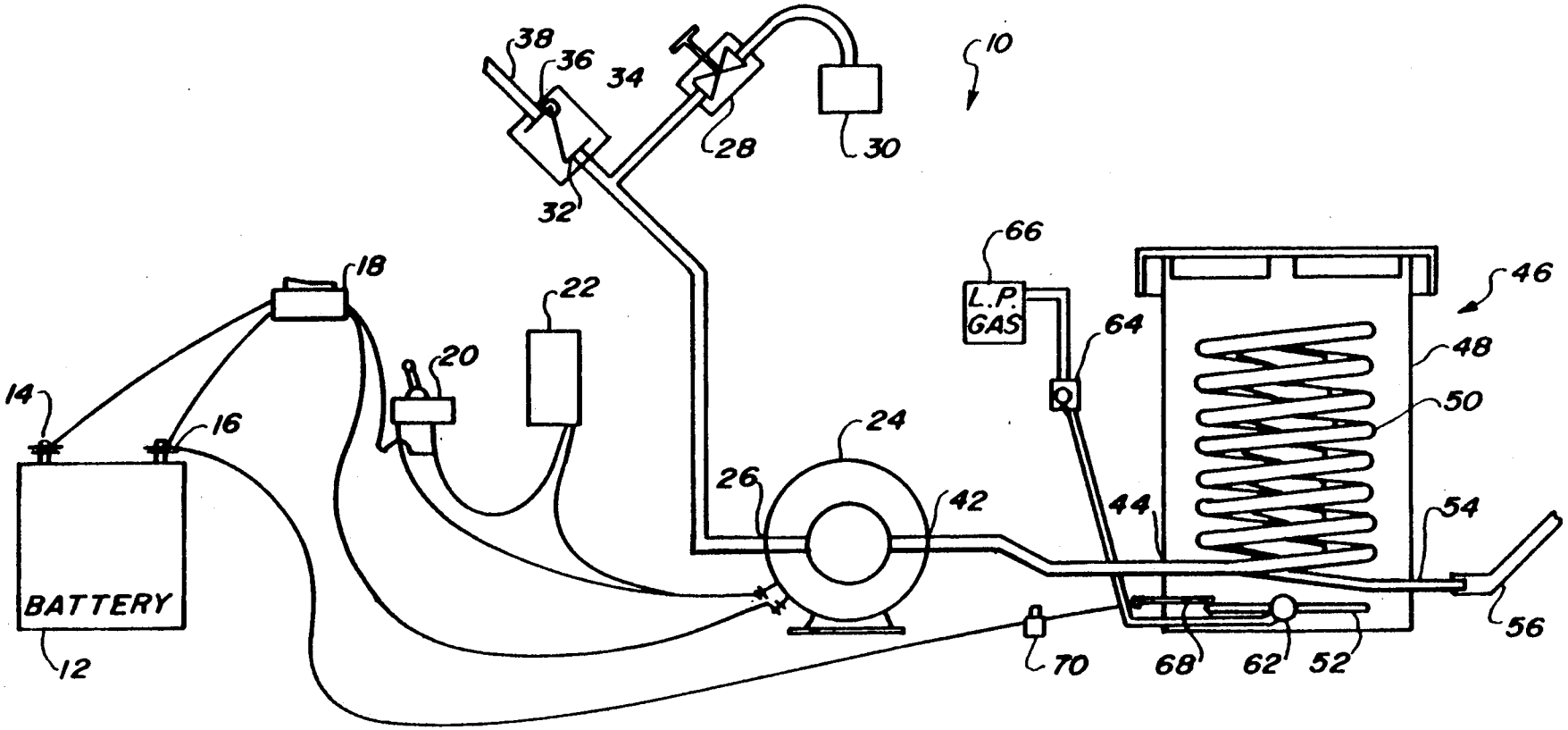
FIG. 2 is a schematic of the pipe thawing apparatus of FIG. 1.

Referring to FIGS. 1 and 2, a pipe thawing apparatus 10 has a battery 12 having terminals 14 and 16. Terminal 14 of battery 12 is coupled through an on/off rocker switch 18 to one side of a toggle switch 20 and to one side of a cyclical power interrupting device 22. Cyclical power interrupting device 22 is illustratively a bimetallic switch of the type used to cyclically interrupt power to turn signals in cars, such as a fuse input lead HD Flasher 5521536, 12 volt manufactured by REDI. The other side of toggle switch 20 and the other side of cyclical power interrupting device 22 are coupled to one terminal of the electric motor of an electric water pump 24. The other terminal of the electric motor of electric water pump 24 is coupled through rocker switch 18 to terminal 16 of battery 12.

Electric water pump 24 has an inlet 26 coupled through a shut-off valve 28 to a source of water 30, such as a container of chlorinated water, an to an outlet 32 of a check-valve 34. An inlet 36 of check-valve 34 is coupled to the outlet of a return line 38. The inlet (not shown) of return line 38 is coupled to a pipe 40 (FIGS. 3 and 4) to be thawed.

An outlet 42 of electric water pump 24 is coupled to an inlet 44 of a heat exchanger 46. Heat exchanger 46 includes a canister 48 in which a heat exchanger coil 50 is mounted above a gas burner 52. Heat exchanger coil 50 is coupled between inlet 44 of heat exchanger 46 and an outlet 54 of heat exchanger 46.

A flexible feed tube 56 has an inlet end 58 coupled to outlet 54 of heat exchanger 46 and an outlet end or tip 60 for insertion into pipe 40 as will be discussed in more detail later. Flexible feed tube 56 illustratively comprises a coil of plastic tubing having sufficient length to permit tip 60 to be feed into pipe 40 a sufficient distance to bring tip 60 in close proximity to the portion of pipe 40 to be thawed.

Burner 52 of heat exchanger 44 is coupled through a manually operated burner control valve 62 and a temperature and ga control valve 64 to a source of gas, such as a propane gas tank 66. Burner control valve 62 has a knob 63 for manual actuation thereof. Temperature and gas control valve 64 is illustratively a gas control valve No. 377311-120 manufactured by WRACO. It has a temperature sensor (not shown) affixed to heat exchanger 44 and turns off the gas to burner 52 when the temperature of heat exchanger 44 reaches a temperature to which gas control valve 64 is set. An igniter 68 for igniting gas burner 52 is coupled through an ignition switch 70 for actuating igniter 68 to terminal 16 of battery 12. Igniter 68 is a conventional gas burner igniter and generates a spark when ignition switch 70 is depressed.

The heretofore described components of pipe thawing apparatus 10, with the exception of water source 30, return line 38, and feed tube 56 are illustratively mounted in a portable container such as a metal tool box 72. The inlet 36 of check valve 34, the outlet 54 of heat exchanger 46, knob 63 of manually actuated burner control valve 62, and ignition switch 70 are illustratively mounted in the front wall of tool box 72.

Figure 3:
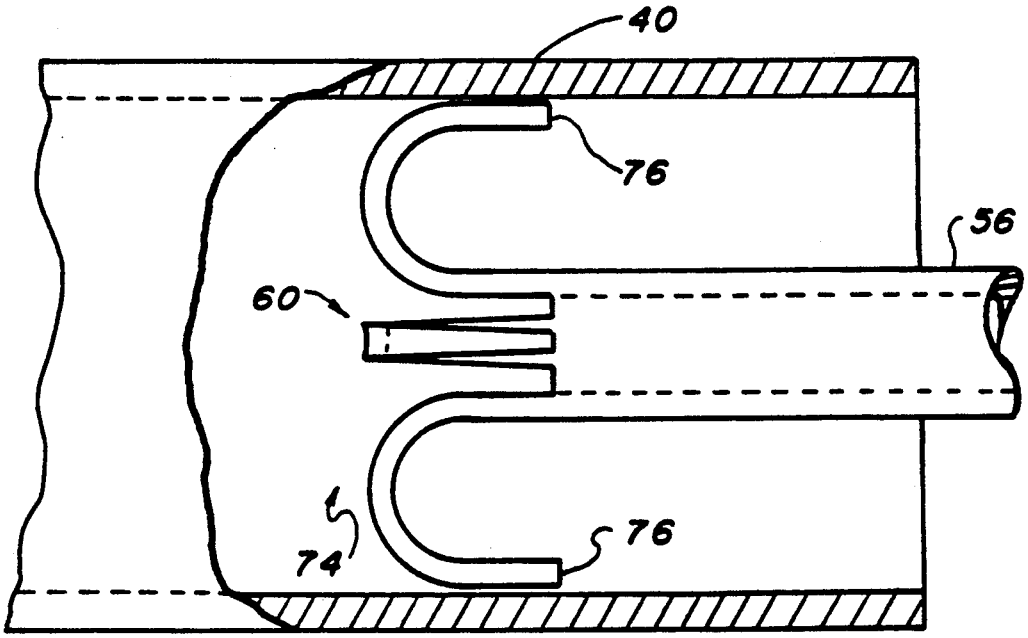
FIG. 3 is a side view of a tip of a flexible feed tube having a spider formed according to one aspect of the invention.
Figure 4:
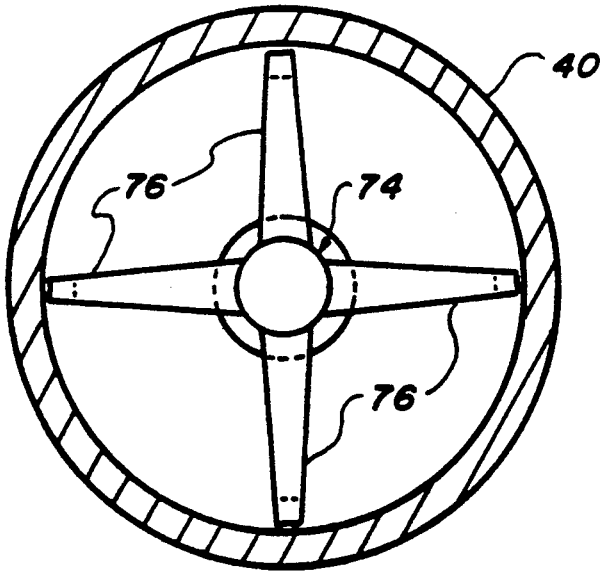
FIG. 4 is an end view of the tip of FIG. 3.

Referring to FIGS. 3 and 4, the tip 60 of feed tube 54 having a spider 74 is shown. Spider 74 comprises a plurality of fingers 76, illustratively four, which curve outwardly and backwardly from tip 60 of feed tube 54. Fingers 76 are resilient and illustratively formed from flexible feed tube 54.

The operation of pipe thawing apparatus 10 is now described with reference to FIGS. 1–4. Pipe 40 is first broken open at an appropriate place such as at an accessible junction in proximity to the portion of pipe 40 that is frozen. Tip 60 of flexible feed tube 56 is inserted into pipe 40 and advanced until it reaches the frozen portion of pipe 40. Return line 38 is also coupled to pipe 40, illustratively by placing a pipe coupling (not shown) to which return line 38 is coupled over the open end of pipe 40. Feed tube 54 illustratively extends through the pipe coupling.

Shut-off valve 28 is coupled to water source 30 and turned on. On-off switch 18 is turned on and toggle switch 20 placed in the continuous position. In the continuous position, toggle switch 20 bypasses cyclical power interrupting device 22 and power continuously is provided to electric pump 24 from battery 12. Pump 24 pumps water into heat exchanger 46 to prime pipe thawing apparatus 10. Once pipe thawing apparatus 10 is primed, shut-off valve 28 is closed and pump 24 then draws its source of water from return line 38 so that pipe thawing apparatus 10 and pipe 40 are a closed system which greatly reduces the possibility of contaminants being introduced into pipe 40.

Manually actuated burner control valve 62 is actuated to couple burner 52 to propane gas tank 66 and ignition switch 70 depressed to ignite burner 52. Pump 24 may be turned off while heat exchanger 46 heats the water in it. Thereafter, pump 24 is run continuously or intermittently by toggle switch 20. When toggle switch 20 is in the continuous position, it bypasses cyclical power interrupting device 22, as mentioned, and power is continuously supplied to pump 24. When toggle switch 20 is in the intermittent position, pump 24 is coupled to battery 12 through cyclical power interrupting device timer 22. Cyclical power interrupting device 22 cyclically couples and decouples power to pump 24. Cyclical power interrupting device 22 can be seen as a form of a timer which periodically opens and closes a set of contacts to cyclically connect and disconnect power to pump 24. Pump 24 therefore runs intermittently and provides pulses of water to heat exchanger 46 so that pulses of heated water are thus provided to pipe 40 through flexible feed tube 54.

Spider 74 centers tip 60 of feed tube 54 in pipe 40 and also facilitates the advancement of tip 60 of feed tube 54 around corners and the like in pipe 40. Fingers 76, being resilient, compress as tip 60 of feed tube 54 is inserted into pipe 40. They also selectively compress as tip 60 is advanced around a corner in pipe 40 to permit the tip 60 to change its direction of travel thus facilitating the advancement of tip 60 around corners. Moreover, fingers 76, since they curve outwardly and backwardly, present a curved surface to pipe 40 which also facilitates the advancement of tip 60 around a corner.

From the preceding description of the preferred embodiment it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. An apparatus for thawing pipe, comprising: means for heating water having an inlet and an outlet;

a flexible feed tube having an inlet coupled to the outlet of the water heating means and an outlet for insertion into the pipe;

means for providing a pulsating stream of heated water from the water heating means to the flexible feed tube, wherein a pulsating stream of heated water is directed into the pipe through the flexible feed tube to melt the ice.

2. The apparatus of claim 1 wherein the pulsating stream of water providing means comprises a water pump and means coupled to the water pump for cyclically energizing and deenergizing it; means for coupling the water pump to the water heating means; the water heating means comprising a heat exchanger having a coil of copper tubing therein having a first end coupled to the inlet of the water heating means and a second end coupled to the outlet of the water heating means, the heat exchanger means further including means for applying heat to the coil of tubing.

3. The apparatus of claim 2 wherein the pump is coupled between the water heating means and a source of water.

4. The apparatus of claim 3 wherein the pump has an electrical motor and the means for cyclically energizing and deenergizing the pump comprises means for cyclically coupling and decoupling the electric motor to a source of electric power.

5. The apparatus of claim 4 wherein the means for cyclically coupling and decoupling the electric motor to a source of electric power comprises a bimetallic element coupled in series between the electric motor and the source of electric power.

6. The apparatus of claim 3 and further including return means for coupling the pipe to the inlet of the pump.

7. The apparatus of claim 1 wherein the outlet of the flexible feed tube includes spider means for centering the outlet of the flexible feed tube in the pipe and facilitating movement of the outlet of the flexible feed tube through the pipe.

8. The apparatus of claim 7 wherein the spider means for centering the outlet of the flexible feed tube in the pipe comprises a plurality of resilient fingers curving radially outwardly and backwardly from the outlet of the flexible feed tube.

9. An apparatus for thawing pipe, comprising heat exchanger means for heating water having an outlet, a coil of tubing disposed therein coupled between the inlet and the outlet, and means for applying heat to the coil of tubing;

an electric water pump having an inlet and an outlet;

means for coupling the inlet of the electric water pump to a source of water;

means for coupling the outlet of the water pump to the inlet of the heat exchanger means;

a source of electric power;

means for cylically coupling the electric water pump to a source of electric power to cyclically turn the electric water pump on and off so that the electric water pump supplies a pulsating stream of water to the heat exchanger means;

and a flexible feed tube for insertion into the pipe for providing a pulsating stream of heated fluid from the heat exchange means into the pipe, the flexible feed tube having an inlet coupled to the outlet of the heat exchanger means and also having an outlet for insertion into the pipe.

10. The pipe thawing apparatus of claim 9 wherein the means for cyclically coupling the electric water pump to a source of electric power includes cyclical power interrupting means and switch means for selectively coupling the electric pump to the source of electric power through the cyclical power interrupting means to run the pump cyclically and to the source of electric power bypassing the cyclical power interrupting means to run the pump continuously.

11. The pipe thawing apparatus of claim 10 wherein the means for coupling the inlet of the pump to a source of water comprises a return line coupling the inlet of the pump to the pipe and a shut-off valve for coupling the inlet of the pump to a source of fresh water.

12. The pipe thawing apparatus of claim 9 wherein the outlet of the flexible feed tube includes a spider for centering the outlet of the feed tube in the pipe and facilitating the advancement of the outlet of the flexible feed tube through the pipe, the spider comprising a plurality of resilient fingers curving outwardly and backwardly from the outlet of the flexible feed tube.

13. The pipe thawing apparatus of claim 12 wherein the plurality of fingers comprises four fingers.

* * * * *